United States Patent [19]

Yasuda et al.

[11] 4,064,689

[45] Dec. 27, 1977

[54] ELECTRONIC TIMEPIECE WITH ELECTRO-OPTICAL DISPLAY

[75] Inventors: Tetsuya Yasuda, Tokyo; Yoshio Iinuma, Higashi-murayama; Yuzo Maekawa, Fuchu; Toshikiyo Kato, Sayami; Masaru Yoshida, Kodaira, all of Japan

[73] Assignee: Citizen Watch Co., Ltd., Tokyo, Japan

[21] Appl. No.: 674,842

[22] Filed: Apr. 7, 1976

Related U.S. Application Data

[63] Continuation-in-part of Ser. No. 490,060, July 19, 1974, abandoned.

[30] Foreign Application Priority Data

July 20, 1973 Japan ..... 48-85811

[51] Int. Cl.[2] ..... G04B 19/30

[52] U.S. Cl. ..... 58/50 R; 58/23 R; 58/23 BA; 58/85.5

[58] Field of Search ..... 350/160 LC X; 58/23 R, 58/23 BA, 50 R, 4 A, 85.5; 174/68.5; 339/17 R; 317/101 CC; 340/336

[56] References Cited

U.S. PATENT DOCUMENTS

| | | | |
|---|---|---|---|
| 3,718,842 | 2/1973 | Abbott et al. | 350/160 LC X |
| 3,771,855 | 11/1973 | Burns | 340/336 X |
| 3,778,999 | 12/1973 | Vuffray | 58/23 R |
| 3,781,863 | 12/1973 | Fujita | 340/336 |
| 3,803,827 | 4/1974 | Roberts | 58/4 A |
| 3,914,021 | 10/1975 | Nishimura | 350/160 LC |

*Primary Examiner*—Ulysses Weldon
*Attorney, Agent, or Firm*—Montague & Ross

[57] ABSTRACT

A disk-shaped substrate supports on its front side a liquid-crystal cell bracketed by an upper and a lower glass plate and on its rear side an electric battery along with circuit elements for controlling the selective energization of various electrode leads of the cell to generate different digital symbols, the substrate being sandwiched between two flexible printed sheets whose conductors establish the necessary connections between the battery and the electrode leads of the cell. The connection between corresponding conductors of the two printed sheets is established by metal pins passing insulatedly through apertures in the substrate. A crystal oscillator included in the control circuit is enclosed in a sealed envelope which is received in a trough of the rear substrate face offset from a depression for the battery, the front substrate face being provided with a recess accommodating a chip connected in the wiring pattern of the printed sheet overlying that front face whose extremities are flexed around the lower glass plate to establish contact with conductor terminals carried on projecting marginal portions of the upper glass plate.

20 Claims, 14 Drawing Figures

ELECTRONIC TIMEPIECE WITH ELECTRO-OPTICAL DISPLAY

CROSS-REFERENCE TO RELATED APPLICATION

This is a continuation-in-part of our copending application Ser. No. 490,060 filed 19 July 1974 now abandoned.

FIELD OF THE INVENTION

Our present invention relates to an electronic timepiece in which time is indicated electro-optically with the aid of a display package provided with a multiplicity of selectively energizable electrode leads.

BACKGROUND OF THE INVENTION

The connections between the electrode leads and an associated driving circuit, including an oscillator of the crystal-controlled or the tuning-fork-controlled type working into a multistage frequency divider, are advantageously formed in part by a set of conductors on a printed circuit carried on a flexible sheet, e.g. of polyimide resin, to which energy may be supplied from a battery via a metallic sheet such as a copper foil. An integrated-circuit chip of the LSI (large-scale integration) type can be inserted in the driving circuit to carry out the selective energization of the several electrode leads in response to the oscillator output or to a manual setting signal; such a chip may comprise a molded resinous or ceramic base supporting a semiconductive module.

Although such a printed sheet is highly flexible, excessive bending may damage its conductor array and thereby impair the operation of the timepiece. Thus, difficulties have heretofore arisen in assembling a sheet of this kind with a display package and other components in a limited space such as the interior of the housing of a wristwatch.

OBJECTS OF THE INVENTION

An object of our present invention, therefore, is to provide a highly compact assembly of a display package, a power supply therefor and associated modular circuitry, capable of mass production, for a timepiece of the character referred to, with avoidance of the aforementioned drawback inherent in the use of printed-circuit sheets.

Another object is to provide, in such a timepiece, improved means for supplying electrical energy to the conductors of a printed-circuit sheet through a supporting substrate.

A related object is to provide effective means for securing such a sheet to its substrate.

SUMMARY OF THE INVENTION

According to an important feature of our present invention, an electro-optical display package disposed adjacent the front side of a substrate includes a first and a second plate substantially paralleling the front and rear sides thereof, the first plate having marginal portions which project laterally beyond the second plate and carry the terminals of respective sets of electrode leads for the selective energization of the display elements of the package. A flexible printed sheet, inserted between the display package and the front side of the substrate, carries a wiring pattern whose conductors contact the aforementioned terminals, these conductors being connectable to power-supply means, such as a battery, on the substrate by way of control means in circuit therewith, specifically an IC chip also supported on the substrate.

Advantageously, the chip and the supply battery are mounted on the substrate in mutually offset relationship and on opposite sides, with the battery received in a rear depression of the substrate. An oscillator in a sealed envelope may also be mounted on the rear side of the substrate, preferably likewise in offset relationship with the chip on the front side, and may be connected to the battery and to the chip through another printed sheet overlying the rear face of the substrate. The conductor arrays of the two printed sheets can be interconnected by metallic pins or the like insulatedly traversing the substrate.

The two printed sheets, or either of them, may be secured to the substrate by interposed bonding layers terminating short of all the boundaries of the respective substrate faces, including the circumferences of the transverse bores provided for the passage of the connecting pins. This insures that, in operation, the bonding material will not be extruded into areas which for mechanical, electrical or esthetic reasons are to be kept free therefrom.

BRIEF DESCRIPTION OF THE DRAWING

The above and other features of our invention will now be described in detail with reference to the accompanying drawing in which.

SPECIFIC DESCRIPTION

Figure 1:
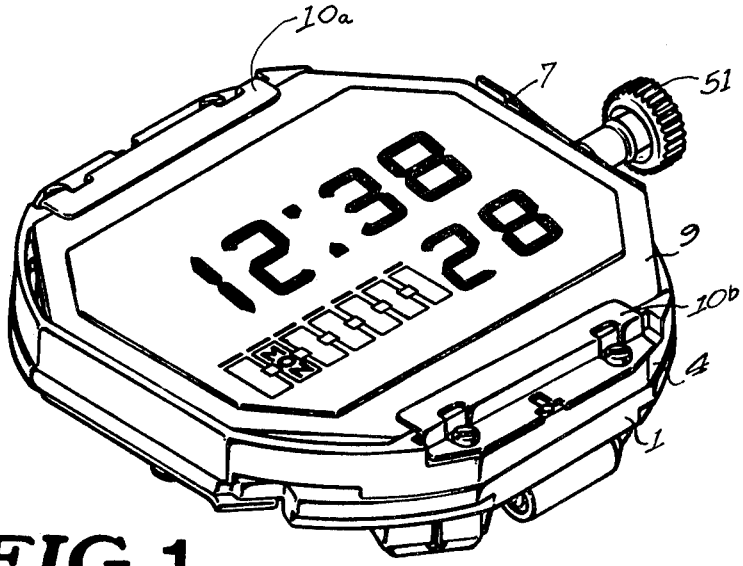
FIG. 1 is a perspective view of an electronic wristwatch embodying our invention.
Figure 2:
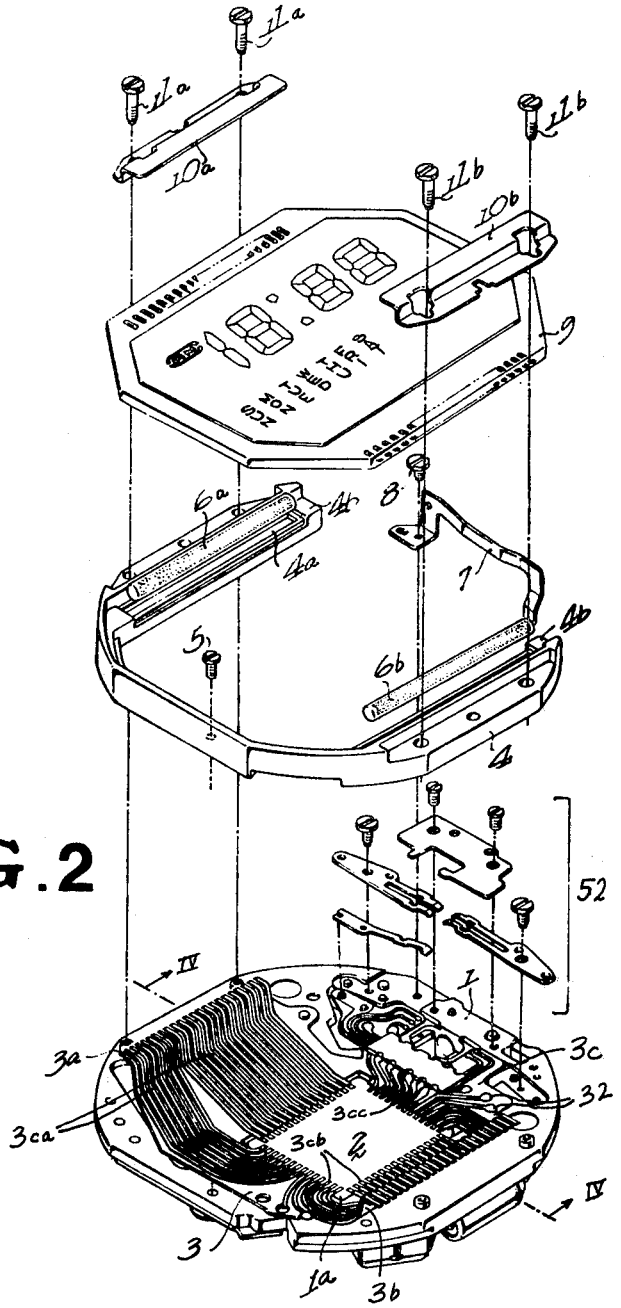
FIG. 2 is an exploded perspective view of a subassembly of the wristwatch at the front side of a substrate.

In FIG. 1 we have shown a wristwatch according to our invention including a generally disk-shaped substrate 1 on whose upper or front side an electro-optical display package 9 is mounted with the aid of a frame 4 and a pair of brackets 10*a*, 10*b*. Frame 4, brackets 10*a*, 10*b* and display package 9 form part of a subassembly more fully illustrated in FIG. 2 which also shows a modular IC chip 2 and a flexible printed sheet 3 with opposite lateral extremities 3*a* and 3*b* of generally S-shaped configuration as more clearly seen in FIG. 4. The printed circuit of sheet 3 includes an array of conductors 3*ca*, 3*cb* and 3*cc*. Conductors 3*ca* and 3*cb* extend between chip 2 and extremities 3*a*, 3*b*, respectively, whereas conductors 3*cc* lead from chip 2 to another sheet portion 3*c* where they are tied by means of connectors 32, in a manner more fully described hereinafter with reference to FIGS. 7 and 8, to corresponding conductors of a second printed sheet 12 (FIGS. 3 and 4) underlying the substrate. The free ends of conductors 3*ca* and 3*cb* are in contact with the terminals of respective electrode leads of display package 9 as particularly described hereinafter with reference to FIGS. 4 and 6. That contact is maintained by a pair of resilient strips 6*a* and 6*b*, in the shape of round bars, which are seated in grooved shelves 4*a*, 4*b* integral with the mounting frame 4. This generally C-shaped frame, secured to the substrate 1 by screws 5 (only one shown), embraces the package 9 from three sides while a resilient yoke 7 bears on the package at its fourth side, this yoke being also secured to the substrate by screws 8 (only one shown). Brackets 10*a* and 10*b*, overhanging the package 9, are fastened to the legs of frame 4 by means of screws 11*a* and 11*b*. Various switch elements, collectively designated 52 (FIG. 2) and 53 (FIG. 3), are likewise screwed to the substrate and are controlled by a knob 51, FIG. 1, for setting the time display in a conventional manner not relevant to our present invention.

Figure 3:
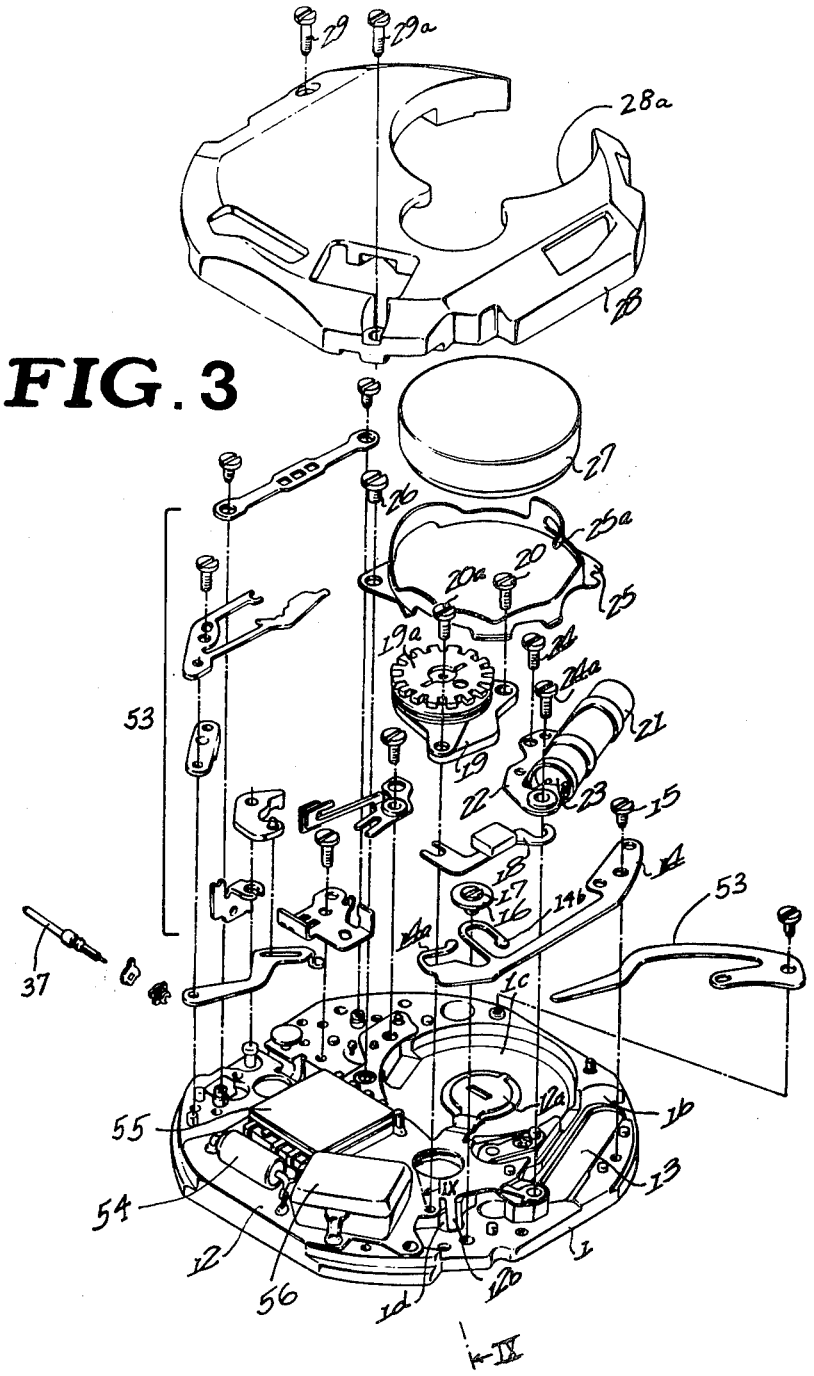
FIG. 3 is a similar exploded view of a subassembly at the rear side of the substrate.
Figure 4:
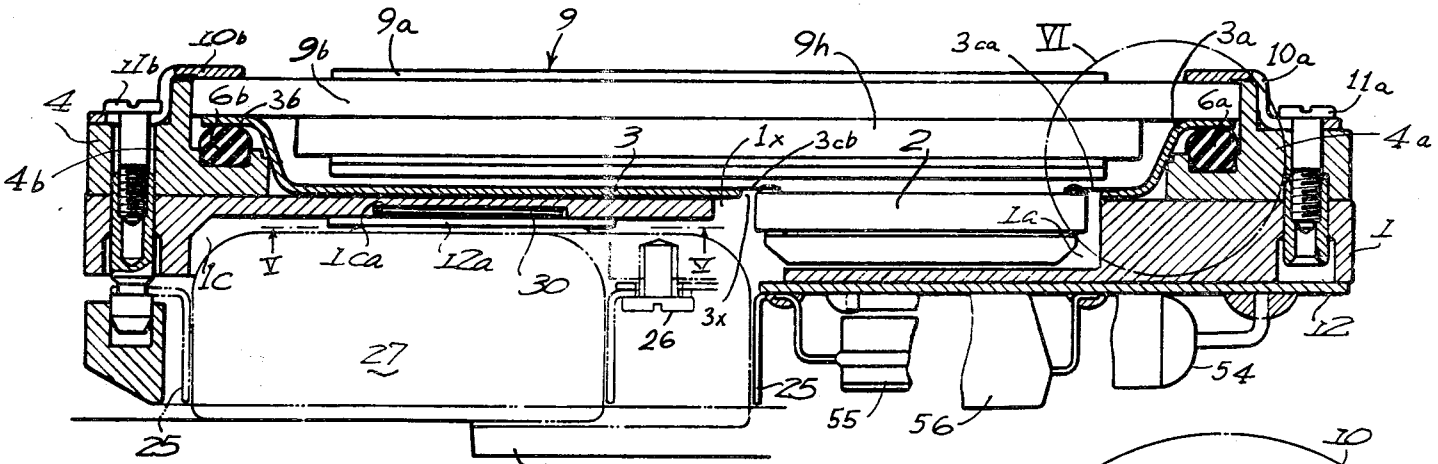
FIG. 4 is a cross-sectional view taken on the line IV — IV of FIG. 2 and drawn to a larger scale.

Chip 2 is accommodated in a recess 1*a*, FIG. 4, whose depth approximately equals the height of the chip and which registers with a cutout 3*x* in sheet 3, conductors 3*ca* and 3*cb* of sheet 3 extending into the cutout and onto the upper chip surface which is substantially flush with the unrecessed part of the front side or face of substrate 1. Recess 1*a* communicates, via a passage 1*x* in the substrate, with a depression 1*c* on the rear side thereof which accommodates a battery 27. The latter, as best seen in FIG. 3, is embraced by a metallic mounting ring 25 secured to the substrate by screws 26 (only one shown), the ring having a flexible tongue 25*a* which can be bent inward to hold the battery in position. As further shown in FIG. 3, substrate 1 has a trough 1*b* adjacent the depression 1*c*, this trough accommodating an encapsuled crystal oscillator 21 whose tubular envelope is held in position by a metallic fitting 22 with the aid of screws 24, 24*a*. The connections to the interior of the sealed oscillator include a printed strip 23 with a pair of conductors respectively engaged by screws 24 and 24*a*, the second screw 24*a* passing insulatedly through the fitting 22 and contacting a connector 18. A switch armature 14 is secured to the substrate by screws 15 and has a J-shaped spur 14*a* guided by a shouldered screw 17, provided with a washer 16, for movement parallel to the substrate under the control of a pushbutton 37 as described below with reference to FIG. 9.

A trimmer condenser for modifying the operating frequency of oscillator 21 comprises a base plate 19 of ceramic material, such as steatite, and a relatively rotatable, peripherally notched plastic disk 19*a* secured to the substrate 1 by means of screws 20 and 20*a*, the latter screw also traversing the connector 18, the two condenser members 19 and 19*a* having conductively coated surfaces. The entire rear-side assembly shown in FIG. 3 is overlain by a nonconductive cover 28 fastened to the substrate by screws 29, this cover having a cutout 28*a* giving access to the battery 27 and to the rotatable condenser plate 19*a*.

Other circuit components, including capacitors 54, 55, 56, are likewise supported on the rear side or face of substrate 1 as shown in FIGS. 3 and 4. The entire assembly is, of course, enclosed in a watch case which has not been illustrated.

Figure 5:
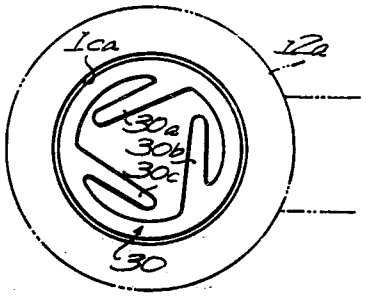
FIG. 5 is a detail view taken on the line V — V of FIG. 4.

The chip 2 on the front side is angularly offset from the oscillator 21 and the battery 27 which are juxtaposed on the rear side so as to minimize the requisite thickness of the timepiece. Battery 27 is in contact with an extension 12*a* of printed sheet 12 overlying a shallow recess 1*ca* in depression 1*c*, that recess being occupied by an elastic insert 30 in the form of a metallic ring with three inwardly extending tongues 30*a*, 30*b* and 30*c* as shown in FIG. 5. The tongues are bent out of the recess, i.e. downwardly as viewed in FIG. 4, so as to urge the sheet extension 12*a* into firm contact with the adjoining negative pole of battery 27. Thus, continuity of energization is insured even if the wristwatch is subjected to shocks causing limited relative displacement between battery 27 and substrate 1 in a direction perpendicular to the substrate faces.

Figure 6:
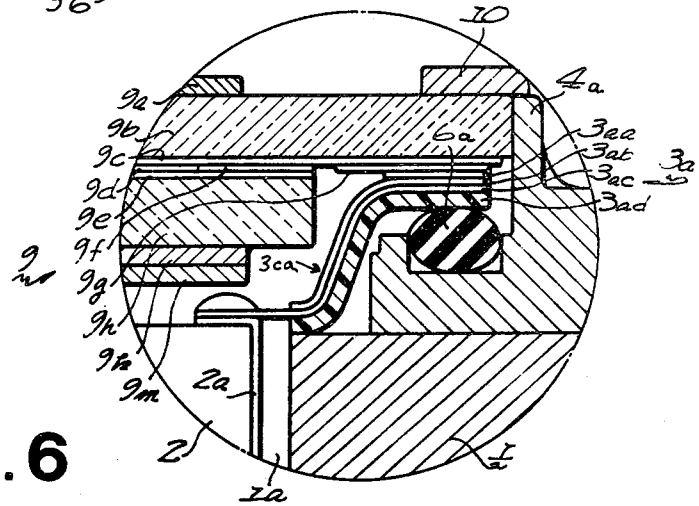
FIG. 6 is an enlarged cross-sectional view of an area encompassed within a circle VI in FIG. 4.

Reference will now be made to FIG. 6 in which the sheet extremity 3*a*, including conductors 3*ca*, has been shown in greater detail along with adjacent parts of the display package 9. The package comprises a stack of elements including an upper biasing electrode 9*a* on a glass plate 9*b*, a set of segmental excitation electrodes 9*c* conforming to the display of FIG. 1, a liquid-crystal cell 9*d*, a counterelectrode 9*e*, a lower glass plate 9*h* carrying a biasing electrode 9*k* and a reflecting layer 9*m*, a frame 9*f* sandwiched between plates 9*b* and 9*h* to confine the liquid crystal, and a set of leads extending outwardly from the segmental electrodes 9*c* beyond the cell frame 9*f* along the underside of plate 9*b*, these leads ending in individual terminals 9*g*. As will be apparent from FIG. 4, plate 9*b* extends laterally beyond plate 9*h* to form a pair of overhanging marginal portions which rest on the resilient strips 6*a* and 6*b* through the intermediary of sheet extremities 3*a* and 3*b*.

As particularly illustrated in FIG. 6, sheet extremity 3*a* comprises a plastic foil 3*ad* of polyimide resin, for example, on which the corresponding conductors 3*ca* are carried in the form of a printed layer 3*ac* of copper foil. The ends of these conductors carry a thin protective coating 3*ab* of malleable metal topped by a plating 3*aa* of contact metal. It is this plating which engages, under the pressure of strips 6*a*, the overlying terminal 9*g* of the corresponding electrode lead. Again, the resiliency of the mounting insures continuity of contact even if there is relative motion between the package 9 and the substrate 1.

At the chip 2, each conductor 3*ca* is soldered to an associated lead 2*a* of the chip. In view of the large number of these connections, the chip may be freely supported by the several conductor groups 3*ca*, 3*cb*, 3*cc* without coming to rest on the bottom of recess 1*a*, as seen in FIG. 4. This mode of mounting reduces the effect of transverse shocks upon the connections, in view of the small mass of the chip.

Though conductors 3*cb* are substantially longer than conductors 3*ca*, owing to the eccentric positioning of the chip 2 on substrate 1, sheet extremity 3*b* engages the display package 9 in the same manner as extremity 3*a*.

Figure 7:
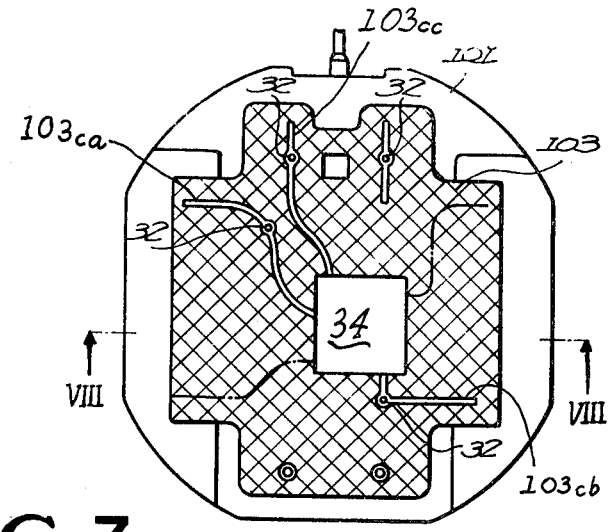
FIG. 7 is a somewhat diagrammatic plan view of the front side of a substrate and an overlying printed sheet in a modified timepiece embodying our invention.
Figure 8:
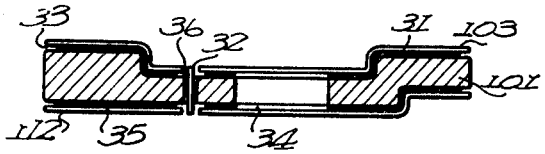
FIG. 8 is a cross-sectional view taken on the line VIII - VIII of FIG. 7.

In FIGS. 7 and 8 we have shown a slightly different substrate 101 again sandwiched between two printed sheets, i.e. an upper sheet 103 and a lower sheet 112, the substrate having a cutout 34 for a nonillustrated chip. Conductors 103*ca*, 103*cb*, and 103*cc* are representative of several groups similar to those shown at 3*ca*, 3*cb* and 3*cc* in FIG. 2. Certain of these conductors are conductively tied to corresponding conductors in the lower sheet 112 by the aforementioned connectors 32 shown as pins passing through bores 36 in substrate 101. The pins 32 may be surrounded by insulating bushings if the substrate consists of conductive material.

The two printed sheets 103 and 112, whose topographies correspond to those of the respective substrate faces, are adhered to the substrate with the aid of respective bonding layers 31 and 35 terminating short of all the substrate boundaries (including the circumferences of cutout 34 and bores 36) so as to leave marginal clearances 33 into which the bonding material may flow upon the application of heat and pressure. Thus, the adhesive will not be extruded beyond the confines of the printed sheets during the bonding operation even if the layers 31 and 35 are relatively heavy to prevent localized weakening of the bond. The layers 31 and 35 could be stamped from coherent sheets into the desired shapes. They may also be produced by a conventional gelatin-printing process, or by screen printing, on the sheets 103, 112 or on the surfaces of substrate 101, e.g. from polyurethane rubber.

Figure 9:
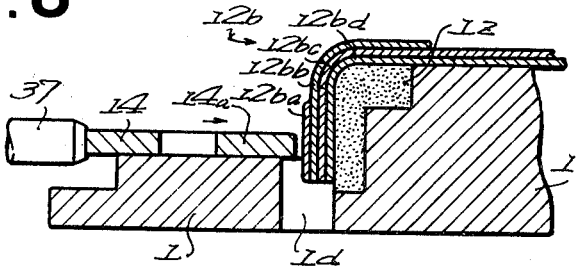
FIG. 9 is a cross-sectional view taken on the line IX - IX of FIG. 3 but drawn to a larger scale.

In FIG. 9 we have shown a manually operable control switch including the armature 14 described with reference to FIG. 3, that armature coacting with a tongue 12*b* integral with sheet 12 partly projecting into a bore 1*d* of substrate 1. Tongue 12*b* has a layered structure, similar to that of sheet extremity 3*a* described with reference to FIG. 6, including a foil 12*bd* of polyimide resin or the like, a conductor 12*bc* of copper foil printed thereon, a thin protective layer 12*bb* of malleable metal and a layer of contact metal 12*ba*. Depression of push-button 37, acting upon armature 14, resiliently forces the spur 14*a* thereof into contact with metal layer 12*ba* to close the circuit. Tongue 12*b* is bent with a relatively large radius of curvature about a resilient pad 1*z* inserted in the substrate 1 at the edge of pole 1*d*.

Figure 10:
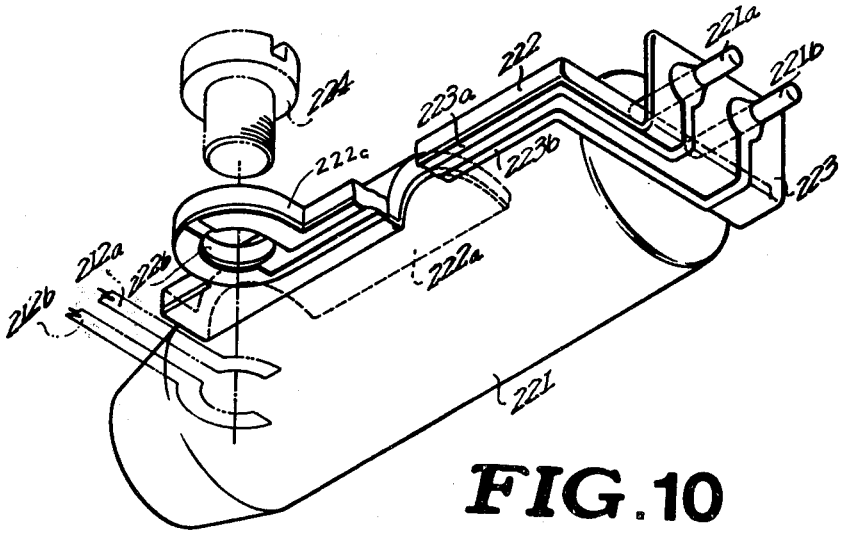
FIG. 10 is a perspective view, drawn to a larger scale, of a modification of a detail shown in FIG. 3.

In FIG. 10 we have shown a modified mounting for an encapsulated oscillator 221 replacing the component 21 of FIG. 3. The oscillator envelope is provided at one end with a pair of terminal pins 221*a*, 221*b* electrically insulated therefrom and from each other. A flexible printed strip 223 overlies a generally L-shaped metallic bracket 222 and carries two conductors 223*a*, 223*b* respectively connected to terminals 221*a*, 221*b*. A cylindrically curved extension 222*a* of bracket 222 partly overlies the oscillator envelope whereas a lug 222*c* with a tapped hole 222*b* receives a complementary screw 224; the two conductors 223*a* and 223*b* terminate at the underside of lug 222*c* in two spaced-apart ring segments respectively registering with a pair of conductors 212*a* and 212*b* of the associated printed sheet to which the lug is clamped with the aid of screw 224. This mode of connection eliminates the need for separate screws 24, 24*a* as used in the assembly of FIG. 3 for connecting the oscillator terminals in an external circuit.

Figure 11:
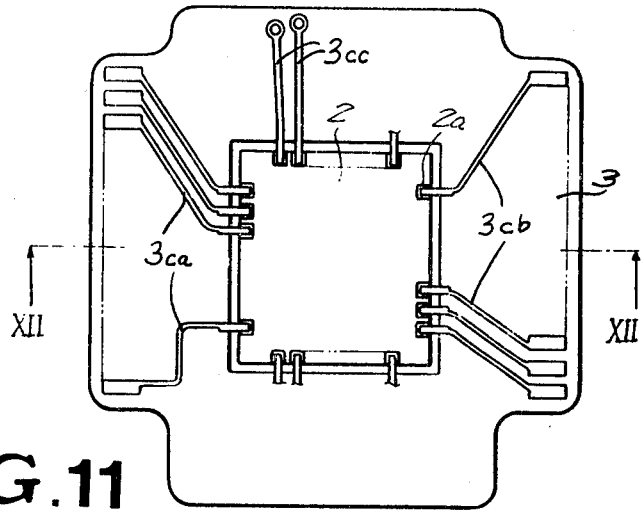
FIG. 11 is a view similar to FIG. 7, illustrating another modification.
Figure 12:
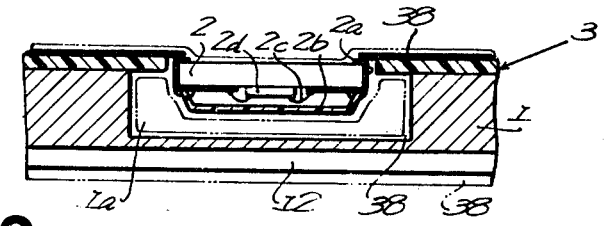
FIG. 12 is a fragmentary cross-sectional view taken on the line XII — XII of FIG. 11.

In FIGS. 11 and 12 we have shown a slightly different layout of substrate 1 with its top sheet 3 and its conductor array 3*ca*, 3*cb*, 3*cc* connected to leads 2*a* of chip 2. The upper and lower sheets 3 and 12 are here shown covered by thin moisture-proofing films 38 of low surface tension, e.g. polytetrafluoroethylene (Teflon), such a film lining also the interior of recess 1*a* and the outer surface of chip 2 which in this instance defines a closed cavity with that recess. Chip 2 is provided on its underside with a flat plastic cover 2*b* of square outline, this cover being secured to the large base of the chip which carries on its underside a semiconductive module 2*d* connected by wires 2*c* to the leads 2*a*.

Moisture-proofing films as shown at 38 may, of course, also be used in other embodiments.

Figure 13:
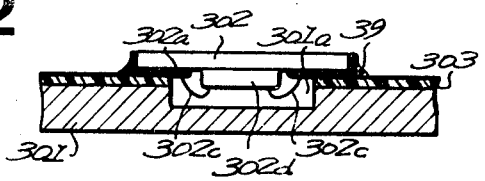
FIGS. 13 and 14 are views similar to FIG. 12, illustrating further modifications.

In FIG. 13 a substrate 301 has a cavity 301*a* spanned by a larger base of a chip 302 whose semiconductive module 302*d* is again connected by wires 302*c* to leads 302*a* contacting respective conductors of a printed sheet 303. The chip base is peripherally bonded to its supporting sheet 303 by adhesive material 39.

Figure 14:
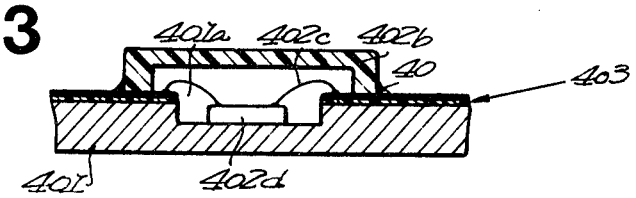

FIG. 14 shows a generally similar arrangement wherein a module 402*d* rests on the bottom of a cavity 401*a* of a substrate 401, that cavity being closed by a plastic cover 402*b* peripherally bonded at 40 to its supporting sheet 403. Wires 402*c* are here connected directly to the conductors of the printed sheet 403 and may be regarded as extensions of these conductors terminating on an exposed chip face.

The accurate alignment of the associated conductors on the chip, the display package and the printed sheets, due to the conformation of the latter to the shape of the substrate, simplifies the process of assembly and enables an efficient mass production of our improved timepiece.

We claim:

1. An electronic timepiece comprising:

a substrate with substantially parallel front and rear sides;

an electro-optical display package adjacent said front side including a first and a second plate substantially paralleling said substrate, said first plate having marginal portions projecting laterally beyond said second plate, said package being provided with electrode leads for generating a variable time indication, said electrode leads having terminals arrayed on said marginal portions;

a flexible printed sheet inserted between said front side and said display package, said printed sheet carrying an array of conductors contacting said terminals;

an electric battery mounted on said rear side;

control means on said substrate in circuit with said battery for selectively energizing said electrode leads by way of said conductors, said control means including an integrated-circuit chip at said front side electrically connected in said array and laterally offset from said battery, said control means further including an encapsulated oscillatory circuit mounted on said rear side at a location laterally offset from said battery and said chip; and a second printed sheet overlying said substrate at said rear side and carrying conductor means connected to said battery, to said oscillatory circuit and to certain conductors of said array.

2. A timepiece as defined in claim 1 wherein said second plate is proximal to said substrate and overhung by said marginal portions, said printed sheet having generally S-shaped extremities flexing laterally about said second plate into contact with said marginal portions.

3. A timepiece as defined in claim 2, further comprising a pair of elastic strips supporting said display package with clearance between said second plate and said substrate, said strips bearing through said extremities upon said marginal portions.

4. A timepiece as defined in claim 1 wherein said substrate is provided with a front recess accommodating said chip, said recess having a depth at least equaling the height of said chip, said printed sheet having a cutout substantially registering with said recess, said conductors extending into said cutout and terminating on an exposed face of said chip.

5. A timepiece as defined in claim 4 wherein said substrate is provided with a rear depression partly receiving said battery, said substrate forming a passage between said recess and said depression.

6. A timepiece as defined in claim 1 wherein said plates are of glass, said display package including a liquid-crystal cell sandwiched between said plates.

7. An electronic timepiece comprising:

a substrate with substantially parallel front and rear sides;

electro-optical display means adjacent said front side provided with electrode leads for generating a variable time indication;

a first flexible printed sheet overlying said substrate at said front side and carrying a wiring pattern with first conductors contacting said electrode leads;

a second flexible printed sheet overlying said substrate at said rear side and carrying a wiring pattern with second conductors respectively connected to said first conductors;

an electric battery supported on said substrate adjacent said rear side; and control means in circuit with said battery for selectively energizing said electrode leads by way of said first and second conductors, said control means being supported on said substrate adjacent said rear side through the intermediary of said second printed sheet.

8. A timepiece as defined in claim 7 wherein said substrate is provided with a recess at said front side, said first printed sheet having a cutout registering with said recess, further comprising an integrated-circuit chip seated in said cutout and electrically connected in the wiring diagram of said first printed sheet.

9. A timepiece as defined in claim 8, further comprising seal means spanning said recess and overlying said chip.

10. A timepiece as defined in claim 9 wherein said seal means includes a larger base rigid with said chip.

11. A timepiece as defined in claim 7 wherein said substrate is provided with a depression offset from said recess at said rear face, said battery being partly received in said depression.

12. A timepiece as defined in claim 11 wherein said substrate is provided at said rear side with a trough offset from said depression, said electronic control means including a crystal oscillator provided with a sealed envelope seated in said trough.

13. A timepiece as defined in claim 12, further comprising cushioning means for said envelope in said trough.

14. A timepiece as defined in claim 12 wherein said oscillator is provided with output terminals extending through said envelope, further comprising a flexible printed strip with third conductors respectively connected to said terminals and fastening means for said envelope holding said third conductors in contact with certain of said second conductors.

15. A timepiece as defined in claim 11 wherein said second printed sheet has a portion received in said depression and provided with a conductive area, further comprising resilient means in said depression bearing upon said second printed sheet for keeping said conductive area in contact with a pole of said battery.

16. A timepiece as defined in claim 7 wherein said substrate is formed with a shoulder underlying a part of said second printed sheet carrying one of said second conductors, said control means including a metallic switch element confronting said part and actuating means for displacing said switch element toward said shoulder into contact with said one of said second conductors.

17. A timepiece as defined in claim 7 wherein said substrate is provided with throughgoing apertures, the connections between said first and second conductors including insulated metal pins traversing said apertures.

18. A timepiece as defined in claim 17 wherein said front and rear sides are provided with bonding layers adhesively securing said printed sheets thereto, said bonding layers terminating short of said apertures.

19. A timepiece as defined in claim 7, further comprising thin moisture-proofing films of low-surface-tension insulating material on the exposed surfaces of said printed sheets.

20. A timepiece as defined in claim 19 wherein said shoulder is padded.

* * * * *